United States Patent [19]

Miura

[11] Patent Number: 4,700,586

[45] Date of Patent: Oct. 20, 1987

[54] MECHANISM FOR PREVENTING SIMULTANEOUS LOCKING OF MULTI-COLUMN SWITCHES

[75] Inventor: Teiichi Miura, Furukawa, Japan

[73] Assignee: Alps Electric Co., Ltd., Japan

[21] Appl. No.: 856,693

[22] Filed: Apr. 28, 1986

[30] Foreign Application Priority Data

Apr. 27, 1985 [JP] Japan ..... 60-63677[U]

[51] Int. Cl.[4] ..... G05G 1/02; H01H 9/26

[52] U.S. Cl. ..... 74/483 PB; 200/5 E; 200/50 C

[58] Field of Search ..... 74/483 PB; 200/5 E, 200/5 EA, 5 B, 5 C, 50 C

[56] References Cited

U.S. PATENT DOCUMENTS

| | | | |
|---|---|---|---|
| Re. 27,836 | 12/1973 | Hansen | 74/483 PB |
| 2,680,382 | 6/1954 | Peterson et al. | 74/483 PB |
| 3,271,529 | 9/1966 | Pawelka et al. | 200/5 C |
| 3,544,739 | 12/1970 | Shak | 200/5 E |
| 3,722,313 | 3/1973 | Schadow | 74/483 PB |
| 4,095,059 | 6/1978 | Nishioka et al. | 200/5 B |
| 4,297,540 | 10/1981 | Tsutsui et al. | 74/483 PB |
| 4,309,579 | 1/1980 | Kondo et al. | 200/50 C |
| 4,386,252 | 5/1983 | Kondo et al. | 200/50 C |
| 4,584,897 | 4/1986 | Sharp, Jr. | 74/483 PB |

*Primary Examiner*—Cornelius J. Husar
*Assistant Examiner*—Peter M. Cuomo
*Attorney, Agent, or Firm*—Guy W. Shoup

[57] ABSTRACT

Simultaneous actuation of switches belonging to separate columns in a switch matrix is prevented by means of opposed preventing members which slide strokes of predetermined length in opposed directions. The preventing members having competing sections formed on opposite sides of a gap which is less than twice the length of the predetermined stroke and these sections compete for space in the gap when their respective preventing members slide so that only one preventing member can slide the full length of its stroke at a time.

8 Claims, 9 Drawing Figures

MECHANISM FOR PREVENTING SIMULTANEOUS LOCKING OF MULTI-COLUMN SWITCHES

FIELD OF THE INVENTION

This invention relates to a mechanism for preventing simultaneous actuation of switches belonging to separate columns of a switch matrix composed of multiple columns arranged in parallel with each column including multiple interlocked push-type switches arranged linearly in the column.

DESCRIPTION OF THE PRIOR ART

Hitherto, a mechanism for preventing simultaneous actuation of switches has been known only for multiple switches arranged in one column that being a single switch column which includes a plurality of straight rod-like cams arranged in series between the switches each cam having on its end faces a tapered surface engageable with the switch and mutually-abutable surface continuous with the tapered surface for abutting against an adjacent cam. The cams are slidable in the column so that only one switch actuator can slip through the series at a time. However, when a group of switches are distributed among multiple columns each including multiple interlocked switches, a mechanism for preventing simultaneous actuation of switches belonging to different columns is not known; thus, in a multicolumn arrangement these switches can be operated simultaneously by for example a finger unintentionally pressing between adjacent columns, to cause simultaneous inputting of signals.

SUMMARY OF THE INVENTION

It is a general object of the present invention to solve the foregoing problem of the prior art, by providing a mechanism for preventing simultaneous actuation of inter-column switches distributed among multiple columns so that switches belonging to different columns are prevented from being actuated simultaneously.

To achieve the foregoing object, the present invention provides a mechanism for preventing inter-column simultaneous actuation of switches distributed among multiple columns, by means of at least two preventing members positioned side by side for sliding in parallel but opposed directions over a limited displacement length (slide stroke) each having a bearing section projecting into a region between the preventing members with a gap normally provided between the bearing sections of the preventing members spacing them apart in the sliding direction, by a distance which is less than twice the slide stroke of the preventing members and preferably equal to or slightly greater than the distance of the slide stroke of the preventing members.

DESCRIPTION OF THE PREFERRED EMBODIMENT

An embodiment of the present invention will now be described with reference to the drawings.

Figure 1:
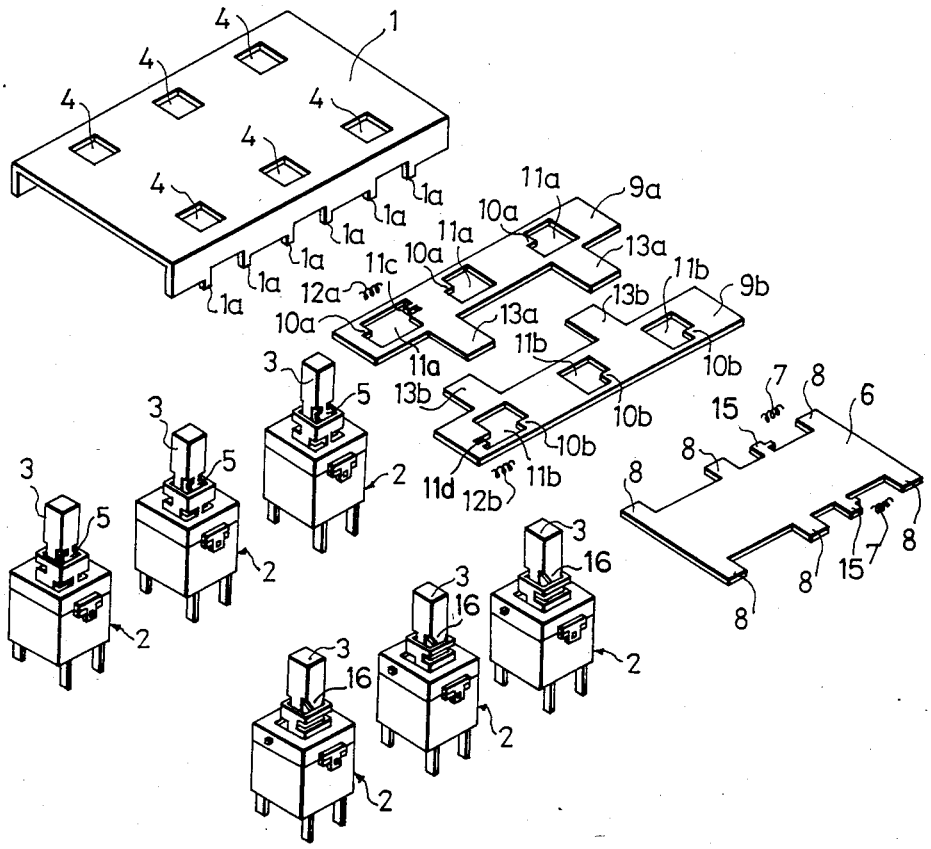
FIG. 1 is an exploded perspective view of an embodiment of a multi-column switch assembly according to the present invention.
Figure 2:
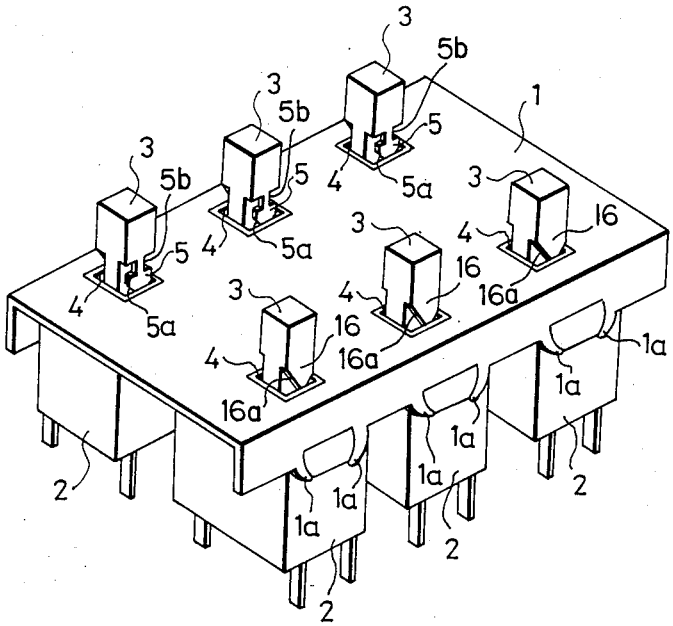
FIG. 2 is a perspective view of the whole assembly.
Figure 3:
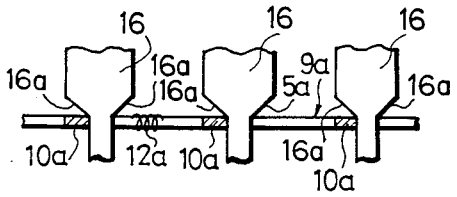
FIG. 3A is a schematic mechanical diagram showing the first switch-column whose switches are all OFF.
FIG. 3B is a schematic mechanical diagram showing the first switch-column with one switch actuated.
Figure 3:
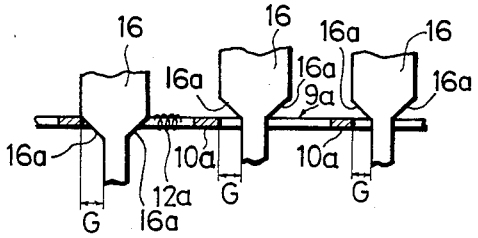
Figure 4:
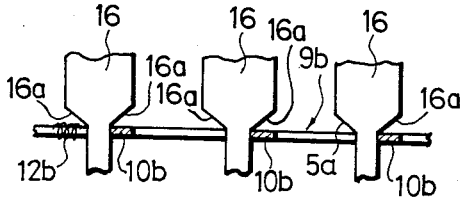
FIG. 4A is a schematic mechanical diagram showing the second switch-column whose switches are all OFF.
FIG. 4B is a schematic mechanical diagram showing the second switch-column with one switch actuated.
Figure 4:
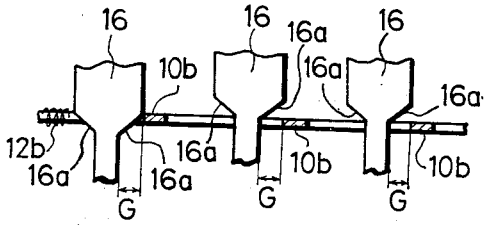

In the drawings, reference numeral 1 indicates a chassis bored with thru-holes 4, through which the head portion of a slide 3 of each switch 2 passes. Each switch 2 is held in place by staking portions 1*a* of the chassis as shown in FIG. 2.

On the front face of each slide 3, a control section 5 is formed for actuating the preventing members and interlocking cam described below; this control section 5 having opposed tapered surfaces 5*a*.

Reference numeral 6 indicates a sliding interlock cam which has coil springs 7, held by spring retaining sections 15 thereof for urging the interlock cam against the right side of the control section 5 of the slide 3. Both sides of the interlock cam are formed with symmetrically projections 8, which slide mutually against the tapered surfaces 5*a* of the control sections 5 of the slides 3 to lock the corresponding slide 3 by engaging into notches 5*b* provided at a top portion of the control sections 5. This interlock cam 6 is positioned between the two columns A and B of the switches 2.

Reference numerals 9*a* and 9*b* indicate respective preventing members positioned below the two switch columns A, B and the interlocking cam 6. Cut-outs are formed in the preventing members 9*a* and 9*b* respectively to define engage sections 11*a* and 11*b*, through which the slides 3 must pass in order to move their respective switch 2 from a nonactuated state to an actuated state. These engage sections or cut-outs 11*a*, 11*b* have stepped portions 10*a*, and 10*b*, which engage with the bearing sections 16 on the rear faces of the corresponding slides 3. These stepped portions 10*a* and 10*b* are located on mutually opposed sides of the preventing members 9*a* and 9*b* corresponding to respective switch-columns to thereby cause the preventing members 9*a*, 9*b* to slide in mutually opposite directions when their respective slides 3 are pushed downward toward from their non-actuated position to the fully actuated position. The preventing members are urged to return to their normal positions by means of coil springs 12*a* and 12*b* held by retaining sections 11*c*, 11*d* formed on the members 9*a*, 9*b*.

Projecting into the region between the preventing members 9*a* and 9*b* are bearing sections 13*a*, and 13*b*, formed at mutually opposed positions. These bearing sections 13*a* and 13*b* are normally spaced apart by a gap G which is less than the sum of the distances of the slide strokes of both preventing member 9*a*, 9*b* and in the preferred embodiment, equal to the length of one such slide stroke.

Figure 5:
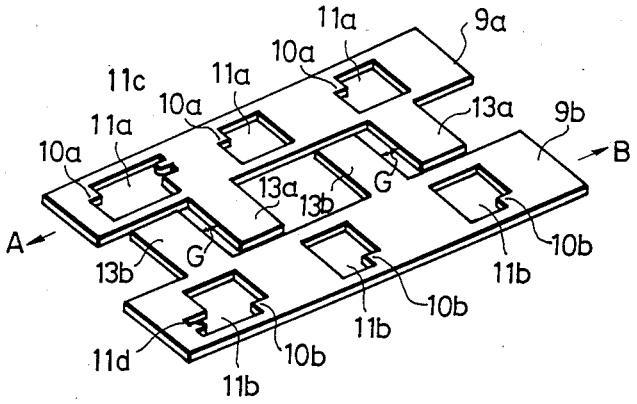
FIG. 5 is a perspective view showing the arrangement of the preventing members.

When a slide 3 of a first desired switch 2 in switch-column A is pushed, the tapered surface 16*a* of the bearing section 16 of the selected slide 3 pushes the stepped portion 10*a* of the engage section 11*a* of the preventing member 9*a*, and thereby causes the preventing member 9*a* to slide to the left by a distance identical to "G" as indicated by the arrow in in FIG. 5 while the slide 3 is locked by the interlocking cam 6 engaging its notch 5*b*. In the above state, if the slide 3 of a second switch 2 belonging to the second switch-column B is pushed, the slide 3 of the first switch 2 having been locked by the interlock cam 6 in the first switch-column A, is released and returns to its initial state by action of the interlock cam 6 and the tapered surface 5*a* of the control section 5 of the second slide 3 of the second pushed switch 2 belonging to the second switch-column. The tapered surface 16*a* of the second switch also causes the preventing member 9*b* to slide to the right a distance identical to "G" as indicated by the arrow in FIG. 5. The second pushed switch 2 in switch-column B is then locked in the depressed state by the interlocking cam engaging the notch 5*b* of the slide 3.

Figure 6:
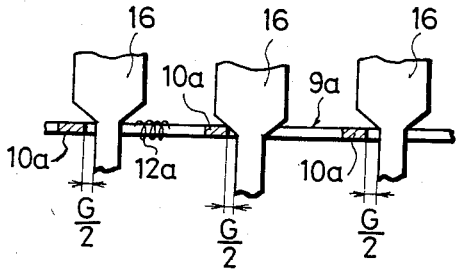
FIGS. 6A and 6B are schematic mechanical diagrams showing the switches of respective switch-columns when two switches, one from each column, are actuated simultaneously.
Figure 6:
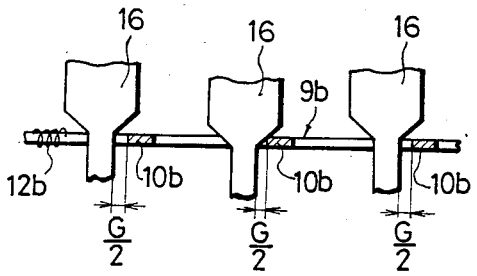

However, if two slides 3, 3 of any desired switches 2A and 2B of the first and second switch-columns A, B are pushed simultaneously as illustrated in FIGS. 6A and 6B with equal force, the preventing members 9*a* and 9*b* slide respectively in their mutually opposite directions only by a distance of approximately one half of "G" before the bearing section 13*a* of the first abuts against bearing section 13*b* of the second and both are stopped. In other words the bearing sections 13*a*, 13*b* compete for the space G between them and both bearing sections cannot move fully into that space at the same time. In order for a slide 3 to actuate its respective switch 2 on the same hand, it must be able to move its respective preventing member the distance of a full slide stroke. Therefore switches belonging to opposed preventing members cannot be actuated simultaneously.

Although the foregoing embodiment relates to the example in which multi-column switches are arranged in two columns, the foregoing configuration may be expanded to an arrangement including three or more switch-columns, to which the present invention can be applied by providing additional bearing sections on the other sides of the preventing members.

As described hereinabove, according to the present invention, when the switches distributed among different columns are pushed simultaneously, the preventing members can slide only one half of the stroke required for actuating the switches into their fully locked state; thus, the switches of different columns can not be locked simultaneously, and simultaneous actuation of switches belonging to different switch-columns can be prevented.

While the preferred embodiment described above uses preventing members having equal strokes it is also within the contemplation the present invention to allow unequal strokes so long as the gap between the bearing sections is shorter than the sum of these different strokes. Additionally, while the preferred embodiment shows preventing members which slide longitudinally, it is within the scope of the present invention to provide, for example, rotable preventing members rotating in opposed directions when driven by the switch slides with their bearing sections moving competitively into an angular gap having room enough to allow only one of the preventing members to travel its full angular stroke at a time.

What is claimed is:

1. A mechanism for preventing simultaneous actuation of first and second switches in first and second columns, respectively, of a multicolumn switch assembly, the columns being arranged longitudinally and having a plurality of switches in each column, comprising:

each switch having a slide portion which is depressable from a first position to a second position, said slide having on one side thereof a bearing surface;

first and second slidable preventing members arranged longitudinally spaced apart in parallel with each other, each preventing member being disposed with respect to a respective one of said columns of switches and having a plurality of cutout portions each engageable with a bearing surface of a corresponding one of the switches in the respective column when the slide portion is depressed to the second position so as to slide the preventing member by a predetermined distance in one longitudinal direction of the assembly, said first and second preventing members being slidable in opposite longitudinal direction from the other when switches in the respective columns are depressed;

said first and second preventing members having first and second bearing sections, respectively, which extend toward each other so as to be engageable with each other if said first and second preventing members are both moved at the same time in opposite longitudinal directions, said first and second bearing sections being initially spaced apart by a gap smaller than the sum of the predetermined distances the preventing members must move if switches in both columns are simultaneously depressed to the second position, whereby the bearing sections will compete for space in said gap so that only one of the two preventing members can slide the full length of its predetermined distance of longitudinal movement at a time.

2. A mechanism according to claim 1 wherein said gap is equal to or slightly larger than said predetermined distance.

3. A mechanism according to claim 1 wherein said slide portion has a v-shaped face for engagement with said cut-out means of its respective preventing member.

4. A mechanism according to claim 1 further comprising springs for returning the bearing sections of said preventing members to their normally spaced apart relation.

5. A mechanism according to claim 4 further including an interlock cam positioned between said first and second switches and having projections engageable with said slide means for locking said slide means of said switches in said second position.

6. A mechanism according to claim 5 wherein said slide means have notches with which said interlock cam engages to lock said slide means.

7. A mechanism according to claim 5 wherein said interlock cam is urged toward engagement with said slide means by a spring.

8. A mechanism according to claim 7 wherein said interlock cam is positioned above said preventing members and said slide means each have a control section on a face thereof including a tapered section and an interlock notch provided above the tapered section.

* * * * *